United States Patent [19]

Graf et al.

[11] Patent Number: 4,712,746

[45] Date of Patent: Dec. 15, 1987

[54] METHOD AND APPARATUS FOR FORMING CROSS-WOUND PACKAGES

[75] Inventors: Felix Graf, Winterthur; Ruedi Schneeberger, Seuzach; Georg Symon, Winterthur, all of Switzerland

[73] Assignee: Rieter Machine Works Limited, Winterthur, Switzerland

[21] Appl. No.: 900,095

[22] Filed: Aug. 25, 1986

[30] Foreign Application Priority Data

Aug. 30, 1985 [CH] Switzerland ..... 03759/85

[51] Int. Cl.[4] ..... B65H 54/28

[52] U.S. Cl. ..... 242/43 R; 242/43 B

[58] Field of Search ..... 242/43 R, 43 AB, 43.1, 242/43.2, 18 R

[56] References Cited

U.S. PATENT DOCUMENTS

| | | | |
|---|---|---|---|
| 3,330,492 | 7/1967 | Gonsalves | 242/43 AB |
| 3,489,359 | 1/1970 | Richter | 242/43 R |
| 3,831,872 | 8/1974 | Fisher et al. | 242/43 R |
| 3,945,581 | 3/1976 | Schippers et al. | 242/43 R |

FOREIGN PATENT DOCUMENTS

| | | | |
|---|---|---|---|
| 830773 | 5/1938 | France | 242/43 AB |

*Primary Examiner*—Stanley N. Gilreath

*Attorney, Agent, or Firm*—Werner W. Kleeman

[57] ABSTRACT

Winding of threads into cross-wound packages is effected by a moving traverse mechanism of a main traverse mechanism by which the thread is laid on to the package. The thread runs in a preliminary traverse mechanism between two elongated guide members which form therebetween a gap. The thread extends transverse to the guide members. The thread is additionally influenced by the preliminary traverse mechanism by means of air streams flowing in the longitudinal direction of the gap, these air streams being controlled with respect to timing. In this way, the thread is relatively uniformly tensioned, so that the operation of laying the thread into the package can be performed by the main traverse mechanism with greater precision. In the preliminary traverse mechanism, the thread practically does not come into contact with any fixed components, since no such components are required for its guidance and within the gap the thread is located in a kind of air cushion. Thus the thread is treated gently while there is no wear of moving parts in the preliminary traverse mechanism.

12 Claims, 4 Drawing Figures

II
50

METHOD AND APPARATUS FOR FORMING CROSS-WOUND PACKAGES

BACKGROUND OF THE INVENTION

The present invention broadly relates to thread winding and, more specifically, pertains to a new and improved method and apparatus for winding threads into cross-wound packages.

Generally speaking, the method of the present invention for forming cross-wound packages comprises the steps of guiding a thread arriving from a stationary thread guide by means of a main traverse mechanism containing a moving traverse means through a complete path of traverse movement and laying the thread onto the cross-wound package.

The apparatus of the present invention for forming a cross-wound package employs a thread traverse means of a main traverse mechanism. The thread traverse means causes a traverse movement of the thread which is to be wound up through a complete path of thread traverse movement. The thread extends in the apparatus from a stationary thread guide to the main traverse mechanism.

German Patent Publication No. 3,436,455 shows a wind-up machine using a thread traverse device for moving the thread and in accordance with which the deceleration or acceleration, or both, of the thread movement is reduced in the end regions of the traverse stroke of the thread. In the mentioned embodiments, this is effected by the provision of an air cushion or a suitable stream of air.

Generally known wind-up devices have the disadvantage that the thread portion running through the traverse device or mechanism is not able to follow exactly the reciprocating traverse element because of the very high speed of reciprocation of such traverse element. As a result of the variations in thread tension which arise, this causes a deterioration in the precision with which the thread can be laid in the package to be wound. As a result, ridges can form on the package, and so-called "overthrown ends" can be formed. Also, the reversal point of the thread on the package is not exact and an optimal crossing angle of the threads in the package is not maintained.

In order to avoid these disadvantages it is known to use a so-called double traverse mechanism, that is to insert a preliminary traverse device upstream of the main traverse mechanism. Such an arrangement is known, for example, from the German Patent Publication No. 2,040,479. Most of the known types of main traverse mechanism employ a grooved roller or drum to produce the traverse movement, that is the lateral reciprocation of the thread. In this arrangement, the thread to be wound up runs in a guide groove which is provided over the complete width of the surface of the roller or at least in its two end zones; the guide groove extends on a helical path over the surface and has reversal locations at the roller or drum ends. When the roller or drum is rotating, the groove causes a continuous reciprocating movement of travel of a thread laid therein. The preliminary traverse device usually comprises a traverse thread guide reciprocated along a straight path, as used also in the present invention.

The use of such a preliminary thread traverse device or mechanism provides the advantage that the continual risk of escape of the thread from guidance at the crossing points of the traverse groove in the grooved roller or drum of the main traverse device can be practically completely eliminated. Furthermore, the preliminary traverse device or mechanism provides the advantage of a more uniform tension of the thread to be wound up than can be obtained where this preliminary thread device is omitted. The preliminary traverse device or mechanism substantially provides the force input which is required by the acceleration and deceleration of the thread and due to friction of the thread over the complete traverse path, primarily in the groove. Thus, this force input no longer has to be provided by the main traverse mechanism and the laying of the thread produced by the main traverse mechanism can be carried out more exactly.

Such preliminary traverse mechanisms or devices have rapidly moving mechanical parts, and therefore have the disadvantage that they are subjected to wear during operation. Also, they exert friction and an abrading effect on the thread. Furthermore, the thread can be caught or can jump out of the groove.

Referring to the wind-up machine disclosed in the initially mentioned German Patent Publication No. 3,436,455, it should be remarked that this differs substantially from a double traverse mechanism since the disclosed apparatus has an effect on the thread only in the end regions of the traverse stroke. Thus, this apparatus makes a negligible contribution to the work required for moving the thread. Accordingly, the wind-up machine of this initially mentioned German Patent Publication does not provide the advantages which arise from a double traverse mechanism.

SUMMARY OF THE INVENTION

Therefore, with the foregoing in mind, it is a primary object of the present invention to provide a new and improved method and apparatus for forming cross-wound packages which does not exhibit the aforementioned drawbacks and shortcomings of the prior art constructions.

Another and more specific object of the present invention aims at providing a new and improved method and apparatus for forming cross-wound packages in which the advantages of the double traverse mechanism are obtained and in which the disadvantages associated with preliminary traverse mechanisms such as those disclosed in the initially mentioned German Patent Publication are avoided.

Yet a further significant object of the present invention aims at providing a new and improved construction of an apparatus of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the method of the present invention is manifested by the features that it comprises the steps of running the thread to be wound-up through a gap or slot formed by elongated or elongate guide members in a preliminary traverse mechanism located between the stationary thread guide and the main traverse mechanism. The elongate guide members extend substantially mutually parallel and substantially transverse to the thread. Air streams are generated in rhythm with the movement of the traverse means of the main traverse mechanism. The air streams are time-controlled and flow between the elongate guide members in the longitudinal direction thereof. The step of generating the air streams entails generating these air streams such that they reciprocate over the complete path of traverse movement of the thread between the guide members and thus entrain the thread along with them.

The apparatus of the present invention is manifested by the features that it comprises a preliminary traverse mechanism arranged between the main traverse mechanism and the stationary thread guide. The preliminary traverse mechanism comprises two elongated guide members extending substantially mutually parallel and forming a gap or slot therebetween such that the thread to be wound-up runs through the gap or slot transversely to the elongate guide members. Air jets are provided for directing air streams in both directions longitudinally of the elongate guide members such that the air streams are present between the elongate guide members over the complete path of traverse movement of the thread between the elongate guide members. A control means is provided for controlling the air jets in rhythm or in synchronization with the movement of the movable traverse means of the main traverse mechanism.

Thus, the present invention has the advantages that the thread practically does not come into contact with fixed components for the purpose of guidance in the preliminary traverse mechanism, and thus is practically not subjected to damage or deleterious effects. The thread moves in a kind of air cushion within the gap or slot formed by the elongate guide members. It is not necessary to move a rigid body for guidance purposes, and thus only low masses (air) have to be moved. Accordingly, there is practically no abrasion and no wear of components in the generation of the traverse movement of the thread. Finally, the thread cannot be caught in the preliminary traverse mechanism.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figures 1, 2, 3, 4:
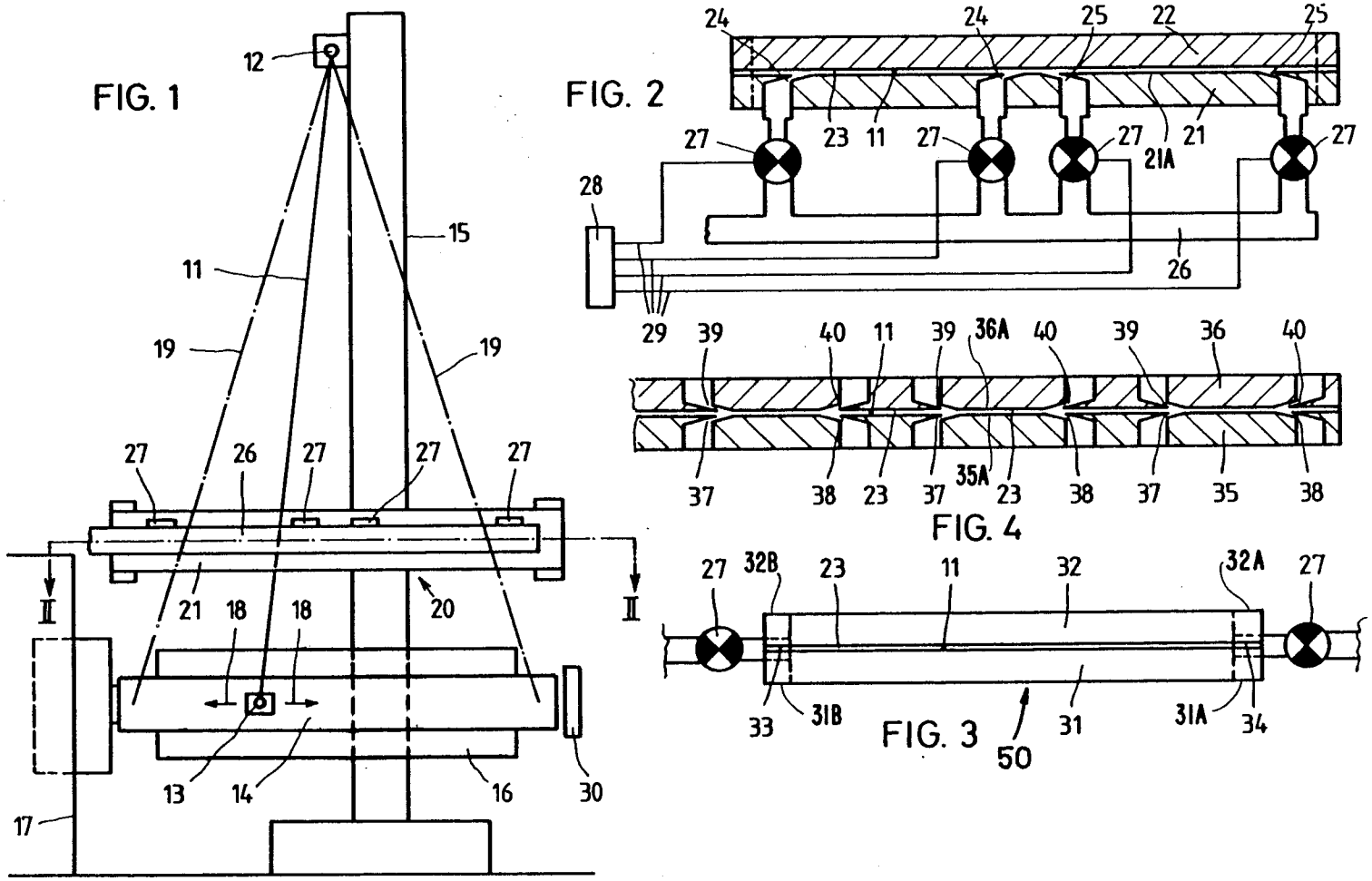
FIG. 1 shows a side view of a thread wind-up device according to the invention.
FIG. 2 shows a cross section of the preliminary traverse mechanism illustrated in FIG. 1 taken along the lines II—II thereof.
FIGS. 3 and 4 show analogous cross sections of further respective embodiments of preliminary thread traverse mechanisms of the apparatus according to the invention.

Describing now the drawings, it is to be understood that to simplify the showing thereof, only enough of the structure of the apparatus for forming cross-wound packages has been illustrated therein as is needed to enable one skilled in the art to readily understand the underlying principles and concepts of the present invention. Turning now specifically to FIG. 1 of the drawings, the apparatus illustrated therein by way of example and not limitation, will be seen to comprise a stationary thread guide 12 formed as a guide ring or eyelet. A thread 11 to be wound up runs from the stationary thread guide 12 to a movable thread traverse means or mechanism 13 of a main traverse mechanism 14. The movable traverse means or mechanism 13 is formed as a movable thread guide. The stationary thread guide 12 and the main traverse mechanism 14 are supported by a support column 15. In FIG. 1, a conventional chuck is provided but is concealed by the main traverse mechanism 14. This chuck serves for winding up the thread 11 to a cross-wound package 16. The chuck is supported by a machine portion 17 and is adjustable in the horizontal direction in dependence of the package diameter so that its spacing from the main traverse mechanism 14 remains continually constant during the thread winding operation. The movable traverse means or mechanism 13 moves back and forth in operation, i.e. reciprocates, as indicated by the two arrows 18. This movable traverse means or mechanism 13 causes the desired crosswise laying of the thread 11 into the package 16. For purposes of moving the movable traverse means or mechanism 13, the latter can be connected in known manner with a not particularly shown conventional helical groove extending around a not particularly shown conventional rotatable grooved roller or drum. The maximum lateral positions or extremes of movement of the traversing thread 11 are indicated by the dash-dotted lines 19.

Additionally, a preliminary thread traverse mechanism 20 is provided. In the cross section of FIG. 2, this preliminary traverse mechanism 20 is illustrated on an enlarged scale relative to FIG. 1. It comprises two guide members 21 and 22 which are formed by two elongated plates extending substantially parallel to each other to form a gap or slot 23 between them. Jets or nozzles 24 and 25 are provided in one of the elongated or elongate plates, for instance in the plate forming the guide or guidance member 21. As viewed in FIG. 2, two jets 24 are directed towards the right and two jets 25 towards the left. The jets 24 and 25 extend from the interior of the guide or guidance member 21 up to the surface or boundary face or side surface 21A thereof forming or at least partially delimiting the gap or slot 23, at which they terminate. The jets or nozzles 24 and 25 do not project beyond this surface 21A into the gap or slot 23. Accordingly, for the traversing thread 11, the jets or nozzles 24 and 25 do not form any kind of obstacle or perturbation. The direction in which air issues from both jets 24 and both jets 25 extends at an acute angle to the longitudinal direction of extent of the elongated gap or slot 23. Compressed air is supplied through a conduit 26 or the like. Air is supplied selectively to the jets 24 and 25 by opening and closing controllable valves 27 or equivalent structure. The thread 11 is guided in the gap or slot 23 by the plates forming the guide or guidance members 21 and 22 and extends transverse to the length of these plates. Upon operation or activation of the jets 24, the thread is moved to the right as viewed in FIG. 2, and it is moved to the left upon operation or activation of the other jets 25. Operation or activation of the jets 24 and 25 is effected via a suitable control device 28; for example, this control device 28 may operate or activate the controllable valves 27 by means of electrical signals conducted by electrical cables or conductors 29.

In operation of the illustrated thread wind-up apparatus, the thread 11 is wound up by rotation of the package 16 about its own axis. The thread 11 runs from the thread guide or eyelet 12 through the gap or slot 23 between the elongate guide members 21 and 22 and transverse thereto and passes via the movable thread traverse means or mechanism 13 onto the package 16. During the winding operation, the movable thread traverse means or mechanism 13 reciprocates in the direction of the arrows 18. This produces a cross winding action so that a cross-wound package 16 is formed.

The back and forth movements or reciprocations of the movable thread traverse means or mechanism 13 are carried out with great speed and are of high frequency. In particular, in the region of the outermost or maximum lateral positions 19 of the thread 11, this thread 11 is subjected to very considerable decelerations and accelerations as well as to considerable variations in tension. As initially mentioned, the preliminary transverse mechanism 20 supports the traverse movement of the thread 11 created by the main traverse mechanism 14, and effects compensation of these varying tensions of the thread 11. In this manner, the preliminary traverse mechanism 20 permits a more uniform movement of the thread 11 through the traverse means or mechanism 13, and thus more precise laying of the thread 11 into the cross-wound package 16.

In operation of the thread winding apparatus or equipment, the jets 24 directed in the right-hand direction of FIG. 2 are operated substantially in rhythm or synchronization with the lateral movements of the moving thread traverse device or mechanism 13 accomplished towards the right. During movement of the movable thread traverse means or mechanism 13 to the left, substantially the leftwardly directed jets 25 are operated. The control means 28 must be provided for this purpose, in order to permit exactly timed adjustment of the emission of the air streams in dependence upon the movement of the movable thread traverse means or mechanism 13. It can be advantageous to control the air streams not only in terms of timing but also in terms of air quantity or flow rate.

In order to obtain optimal cooperation of the main traverse mechanism 14 and the preliminary traverse mechanism 20, the control means or equipment 28 operates in dependence of the reciprocations of the movable thread traverse means or mechanism 13. In the illustrated exemplary embodiment, this is carried out in such manner, that a further or additional control means 30, see FIG. 1, feeds signals to the control means or equipment 28. These signals are dependent upon the direction of movement and the current position of the movable thread traverse means or mechanism 13. On the basis of these signals, the control means or equipment 28 emits control commands to the controllable valves 27 for operation thereof.

If the thread 11 is not guided by means of a thread guide moving back and forth or reciprocating, and the movable traverse means is formed for example by a rotatable grooved roller or drum with the thread 11 being located in the groove of the roller or drum, then the additional control means 30 must deliver signals dependent upon the rotational movement of the grooved roller or drum, that is upon the number of rotations and upon the angular position thereof.

A pneumatically operated preliminary traverse mechanism 50 usable in accordance with the invention is illustrated in its simplest form in FIG. 3. A thread 11, travelling substantially at right angles to the plane of the drawing, is again passed through a gap or slot 23 provided between two plate-like guide members 31 and 32. The thread 11 is reciprocated by air streams created by jets or nozzles 33 and 34 located at respective oppositely situated end faces 31A, 31B and 32A, 32B of the elongate guide members 31 and 32 and which blow alternately in opposite directions longitudinally of the elongate guide members 31 and 32. In this example also, the air quantity or flow rate and the operating intervals or timing of the air streams are controlled by means of the controllable valves 27. This embodiment of the preliminary traverse mechanism 50 is mainly suitable for production of axially short packages, i.e. packages of low traverse length.

The embodiment illustrated in FIG. 4 again comprises two elongate guide members 35 and 36 which have the form of elongated or elongate plates. In distinction to the embodiment of FIGS. 1 and 2, jets or nozzles 37, 38, 39 and 40 are provided in each of the plates defining the guide members 35 and 36. Again these jets or nozzles 37, 38, 39 and 40 extend from the interior of at least one of the elongate plates defining the guide members 35 and 36 to the respective surface or side surface 35A or 36A thereof confronting the gap or slot 23, and in this case are shown to extend from both. In plate or guide member 35, the jets 37 are directed towards the right as viewed in FIG. 4, and the jets 38 are directed towards the left. In plate or guide member 36, the jets 39 are directed towards the right and the jets 40 are directed towards the left. The direction of flow of fluid issuing from these jets 37, 38, 39 and 40 also forms an acute angle relative to the length of the gap or slot 23. Flow of air through the jets or nozzles 37, 38, 39 and 40 is again controlled by controllable valves which, however, have not been illustrated in FIG. 4 to simplify its representation. If the mutually opposed jets 37 and 39 or 38 and 40 are simultaneously supplied with air, then the air distribution produced in the gap or slot 23 is symmetrical with respect to the central plane between the guide members 35 and 36. This provides an optimal, easy movement of the thread 11. The successively arranged jets, for example the group of jets or nozzles 37, the group of jets or nozzles 38, the group of jets or nozzles 39 or the group of jets or nozzles 40, can possibly be operated consecutively in a relay-manner. In this way, a preliminary traverse mechanism of considerable length can be obtained, and thus a traverse mechanism for packages of greater traverse stroke.

The present invention provides another particular advantage if the main traverse mechanism 14 is based on a known type of thread traverse arrangement using a grooved roller or drum. In such an arrangement, the thread 11 can jump in an undesired manner out of the groove. The particular advantage is that a situation cannot arise in which the thread 11 jumps out of its groove and re-engages in another groove which would carry it in the opposite direction to that corresponding to the air flow currently prevailing in the auxiliary or preliminary traverse mechanism 20. This is the case because the air flow in the preliminary traverse mechanism 20 always holds the thread 11 at a considerable angle to that groove in the main traverse mechanism 14 which operates in the direction opposed to this air stream. However, the air stream sets the thread 11 in a disposition in which it lies more or less parallel to the groove which operates on the thread 11 in the same sense as this air stream. Thus, practically only re-threading of the thread 11 into the correct groove is possible, and re-threading into the wrong groove is precluded.

As an example of data regarding relevant orders of magnitude, it is mentioned that the width of the gap or slot 23 preferably lies between 0.2 millimeters and 1 millimeter, and in particular between 0.3 millimeters and 0.4 millimeters. The breadth of the plates forming the guide or guidance members preferably lies between 20 and 50 millimeters. It is to be noted that the thickness and characteristics of the thread 11 to be wound up have to be taken into account relative to the width of the gap or slot 23.

While there are shown and described present preferred embodiments of the invention, it is to be distinctly understood that the invention is not limited thereto, but may be otherwise variously embodied and practiced within the scope of the following claims. Accordingly,

What we claim is:

1. A method for winding a thread arriving from a stationary thread guide to form a cross-wound package, comprising the steps of:

guiding the thread arriving from the stationary thread guide by means of a main traverse mechanism with a movable traverse means through a complete path of traverse movement;

laying the thread onto the cross-wound package;

running the thread to be wound up through a gap formed by elongate guide members in a preliminary traverse mechanism located between the stationary thread guide and said main traverse mechanism;

said elontate guide members extending substantially mutually parallel along substantially said complete path of traverse movement and substantially transverse to the thread;

generating air streams substantially in synchronization with the movement of said movable traverse means of said main traverse mechanism such that said air streams are time-controlled and flow between said elongate guide members in the longitudinal direction thereof; and said step of generating said air streams entailing generating said air streams such that said air streams alternatingly flow in opposite directions between said elongate guide members and thus entrain the thread along substantially said complete path of traverse movement of the thread.

2. An apparatus for winding a thread to form a cross-wound package by means of a movable traverse means of a main traverse mechanism, which movable traverse means causes a traverse movement of the thread to be wound up through a complete path of traverse movement and in which apparatus the thread extends from a stationary thread guide to the main traverse mechanism, comprising:

a preliminary traverse mechanism arranged between the main traverse mechanism and the stationary thread guide;

said preliminary traverse mechanism comprising two elongate guide members extending substantially mutually parallel and forming a gap therebetween such that the thread to be wound up runs through said gap transversely to said elongate guide members;

air jets for selectively alternatingly directing air streams in opposite directions longitudinally of said elongate guide members such that said air streams flow between the elongate guide members and entrain the thread along substantially said complete path of traverse movement of the thread; and control means for selectively controlling said air jets substantially in synchronization with the movement of the movable traverse means of the main traverse mechanism.

3. The apparatus as defined in claim 2, wherein:

said elongate guide members each have an interior and each have a surface;

said gap having a longitudinal direction;

said air jets extending from said interior of at least one of said guide members to said surface thereof; and said air jets opening towards said gap such that air issues from said air jets at an acute angle to said longitudinal direction of said gap.

4. The apparatus as defined in claim 3, wherein:

said air jets comprise jets which are located in the region of the complete path of traverse movement of the thread; and said jets extending at most up to the surface of the related guide member at which they open.

5. The apparatus as defined in claim 2, wherein:

each said guide member has the form of an elongate plate having respective side surfaces; and said respective side surfaces confronting each other and conjointly forming said gap which defines a relatively narrow gap.

6. The apparatus as defined in claim 5, wherein:

said relatively narrow gap has a predetermined thickness; and said predetermined thickness lying between 0.2 and 1 millimeter.

7. The apparatus as defined in claim 5, wherein:

said relatively narrow gap has a predetermined thickness; and said predetermined thickness lying between 0.3 and 0.4 millimeters.

8. The apparatus as defined in claim 2, wherein:

said guide members each have end faces; and said air jets comprise a jet located at each said end face.

9. The apparatus as defined in claim 2, wherein:

said air jets are all located in a single guide member of said guide members.

10. The apparatus as defined in claim 2, wherein:

said air jets are provided in both said guide members.

11. The apparatus as defined in claim 2, further including:

additional control means for controlling said air jets with reference to time and with reference to air flow rate; and said additional control means issuing control commands which are dependent upon a current position of said movable traverse means of said main traverse mechanism.

12. The apparatus as defined in claim 2, wherein:

said air jets comprise at least one group of successively arranged jets provided over said complete path of traverse movement of the thread and operating in the same direction as a predetermined direction of guidance of the thread; and said control means serving for consecutively operating said successively arranged jets.

* * * * *

UNITED STATES PATENT AND TRADEMARK OFFICE

CERTIFICATE OF CORRECTION

PATENT NO. : 4,712,746

DATED : December 15, 1987

INVENTOR(S) : FELIX GRAF et al

It is certified that error appears in the above-identified patent and that said Letters Patent is hereby corrected as shown below:

Column 5, line 17, please delete "transverse" and insert --traverse--

Column 7, line 31, please delete "elontate" and insert --elongate--

Signed and Sealed this

Thirty-first Day of May, 1988

*Attest:*

*Attesting Officer*

DONALD J. QUIGG

*Commissioner of Patents and Trademarks*